US007218220B1

(12) United States Patent
Bovsun

(10) Patent No.: US 7,218,220 B1
(45) Date of Patent: May 15, 2007

(54) SIGNALING SYSTEM

(76) Inventor: Vladimir V. Bovsun, 638 S. 2nd St. Apartment B, Steelton, PA (US) 17113

( * ) Notice: Subject to any disclaimer, the term of this patent is extended or adjusted under 35 U.S.C. 154(b) by 208 days.

(21) Appl. No.: 11/053,463

(22) Filed: Feb. 9, 2005

(51) Int. Cl.
*G08B 1/08* (2006.01)

(52) U.S. Cl. ..... 340/539.14; 340/539.1; 340/691.6; 340/384.1; 340/326; 340/331; 340/332

(58) Field of Classification Search ..... 340/539.14, 340/539.1, 691.1, 691.6, 692, 384.1, 326, 340/331, 332
See application file for complete search history.

(56) References Cited

U.S. PATENT DOCUMENTS 4,237,449 A 12/1980 Zibell
4,365,238 A 12/1982 Kollin
D273,009 S 3/1984 Isaacs
4,731,603 A 3/1988 McRae et al.
4,853,674 A 8/1989 Kiss
5,576,690 A * 11/1996 Waugh et al. ..... 340/539.1

* cited by examiner

*Primary Examiner*—Daryl C Pope

(57) ABSTRACT

A signaling system includes a primary signaling doorbell assembly that includes a sound emitter, an actuator electrically coupled to the sound emitter, and a transmitter electrically coupled to the actuator that is adapted for sending a wireless signal. A power supply is electrically coupled to the actuator. A plurality of secondary signaling assemblies is provided. Each of the secondary signaling assemblies includes a receiver adapted for receiving the wireless signal from the transmitter, a signal member electrically coupled to the receiver, and a power supply electrically coupled to the transmitter and signal member. The signal member is adapted for signaling a person when the receiver receives the wireless signal.

3 Claims, 5 Drawing Sheets

SIGNALING SYSTEM

BACKGROUND OF THE INVENTION

1. Field of the Invention

The present invention relates to signaling devices and more particularly pertains to a new signaling device for signaling when a person is at a door of a dwelling and which includes a plurality of wireless signaling devices, which may be selectively positioned within the dwelling.

2. Description of the Prior Art

The use of signaling devices is known in the prior art. U.S. Pat. No. 4,237,449 describes a device that utilizes illuminated signals for indicating when a person has used a doorbell. Another system utilizing visual signals is found in U.S. Pat. No. 4,365,238. A similar device is found in U.S. Pat. No. 4,731,603 and includes a remote tactile alarm assembly which may be worn by a person to alert them of an alarm.

While these devices fulfill their respective, particular objectives and requirements, the need remains for a doorbell system that, along with a conventional doorbell assembly, also includes one or more wireless signaling assemblies that are in wireless communication with the conventional doorbell assembly. This will allow a person to place doorbells signaling devices where needed. Additionally, it would be advantageous to include non-audible signaling members to allow a person to prevent being disturbed by an audible doorbell.

SUMMARY OF THE INVENTION

The present invention meets the needs presented above by comprising a primary signaling doorbell assembly that includes a sound emitter, an actuator electrically coupled to the sound emitter, and a transmitter electrically coupled to the actuator that is adapted for sending a wireless signal. A power supply is electrically coupled to the actuator. A plurality of secondary signaling assemblies is provided. Each of the secondary signaling assemblies includes a receiver adapted for receiving the wireless signal from the transmitter, a signal member electrically coupled to the receiver, and a power supply electrically coupled to the transmitter and signal member. The signal member is adapted for signaling a person when the receiver receives the wireless signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
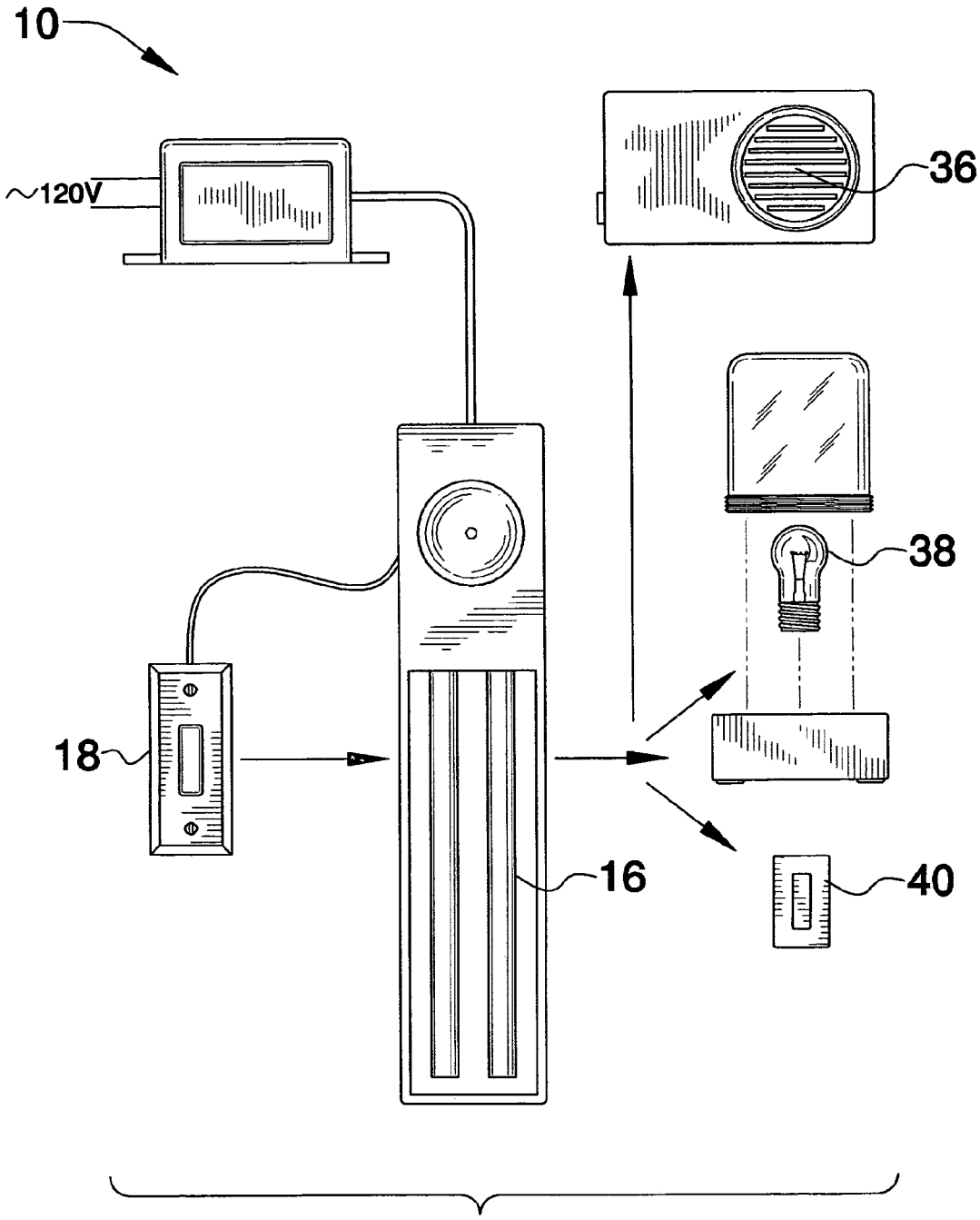
FIG. 1 is a front view of a signaling system according to the present invention.

With reference now to the drawings, and in particular to FIGS. 1 through 5 thereof, a new signaling device embodying the principles and concepts of the present invention and generally designated by the reference numeral 10 will be described.

Figure 2:
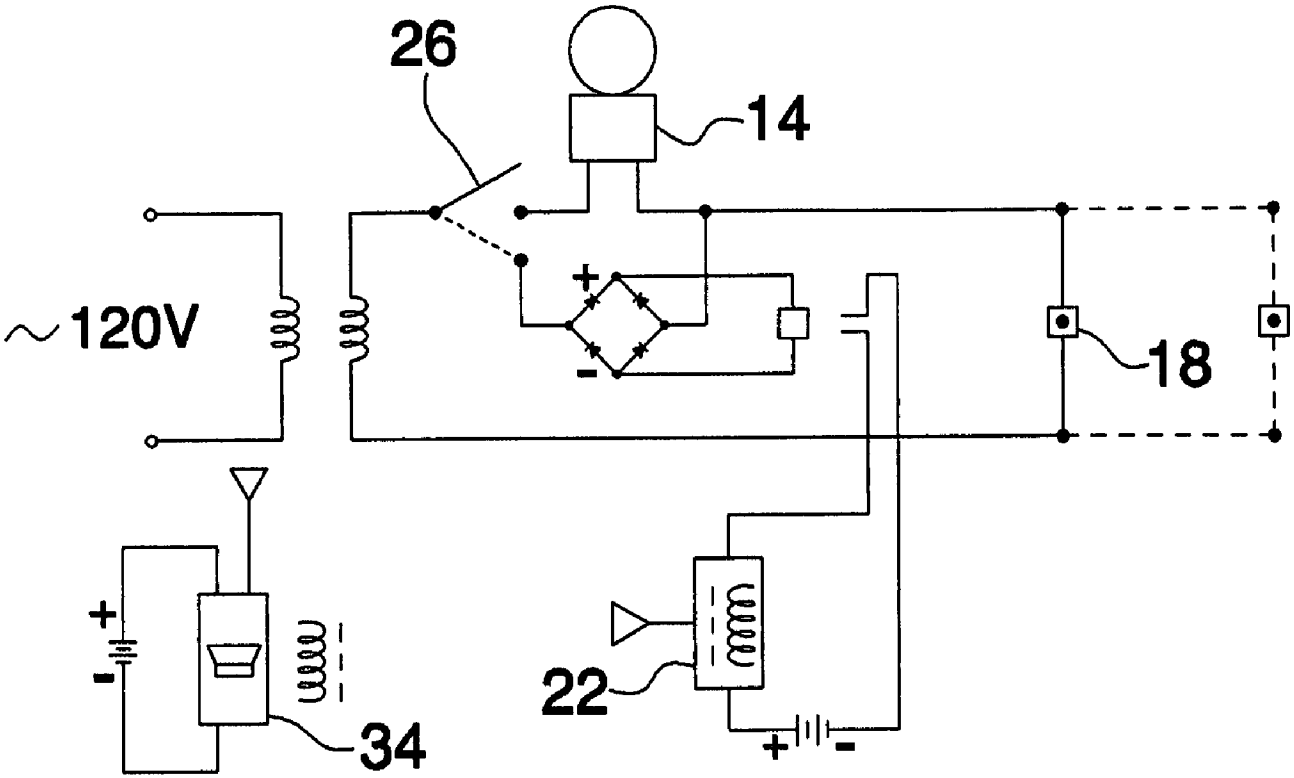
FIG. 2 is an electronic schematic view of the present invention.
Figure 3:
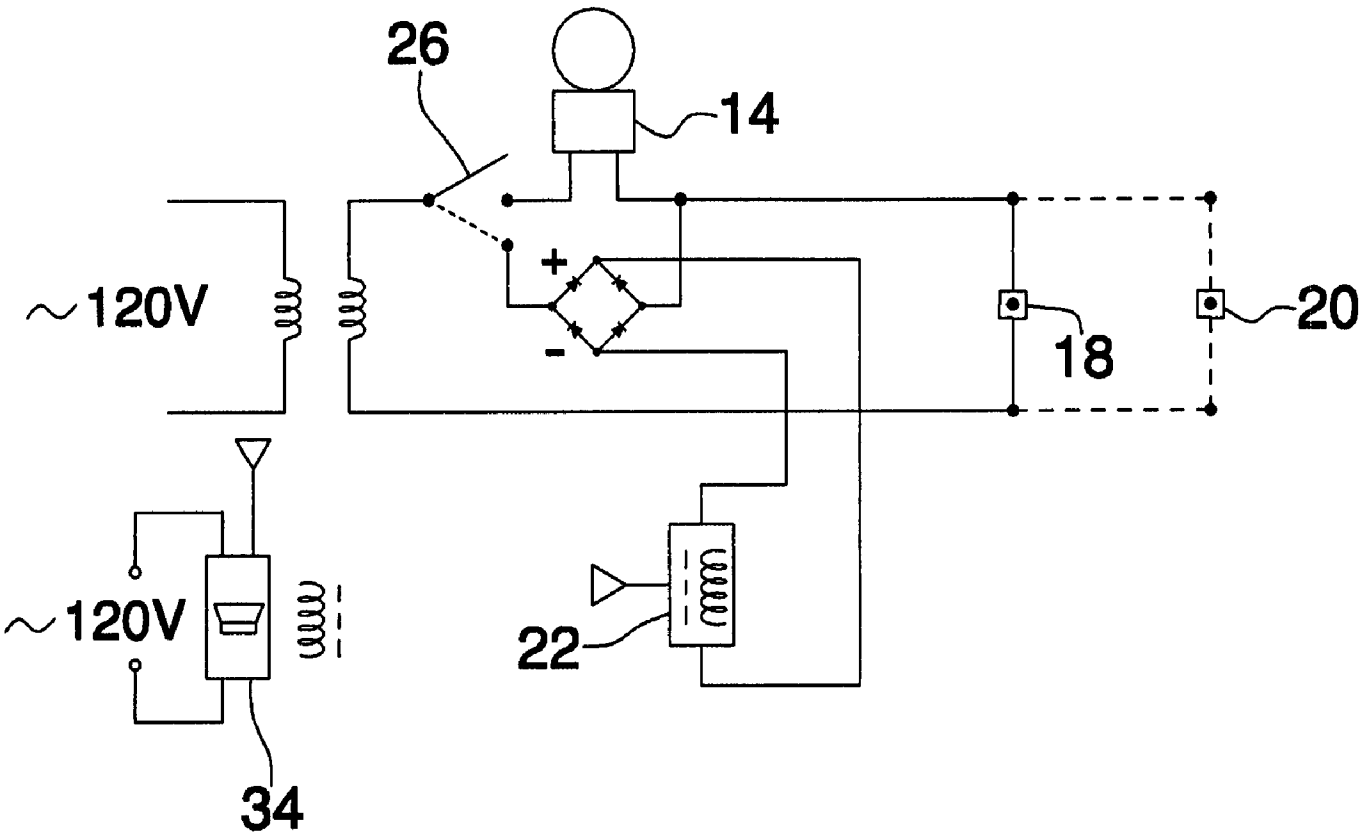
FIG. 3 is a second electronic schematic view of the present invention.
Figure 4:
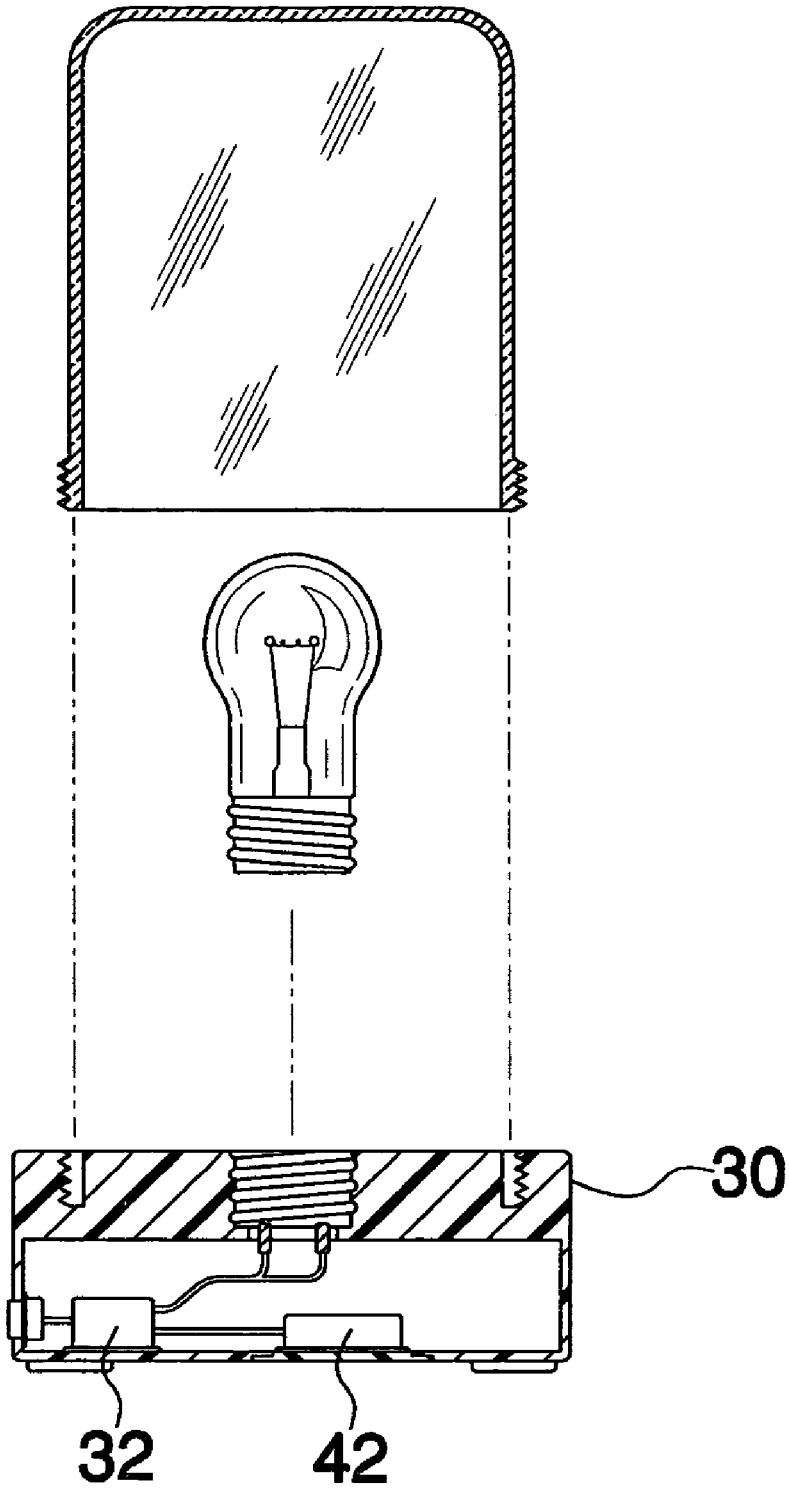
FIG. 4 is a cross-sectional view of a secondary signaling assembly of the present invention.
Figure 5:
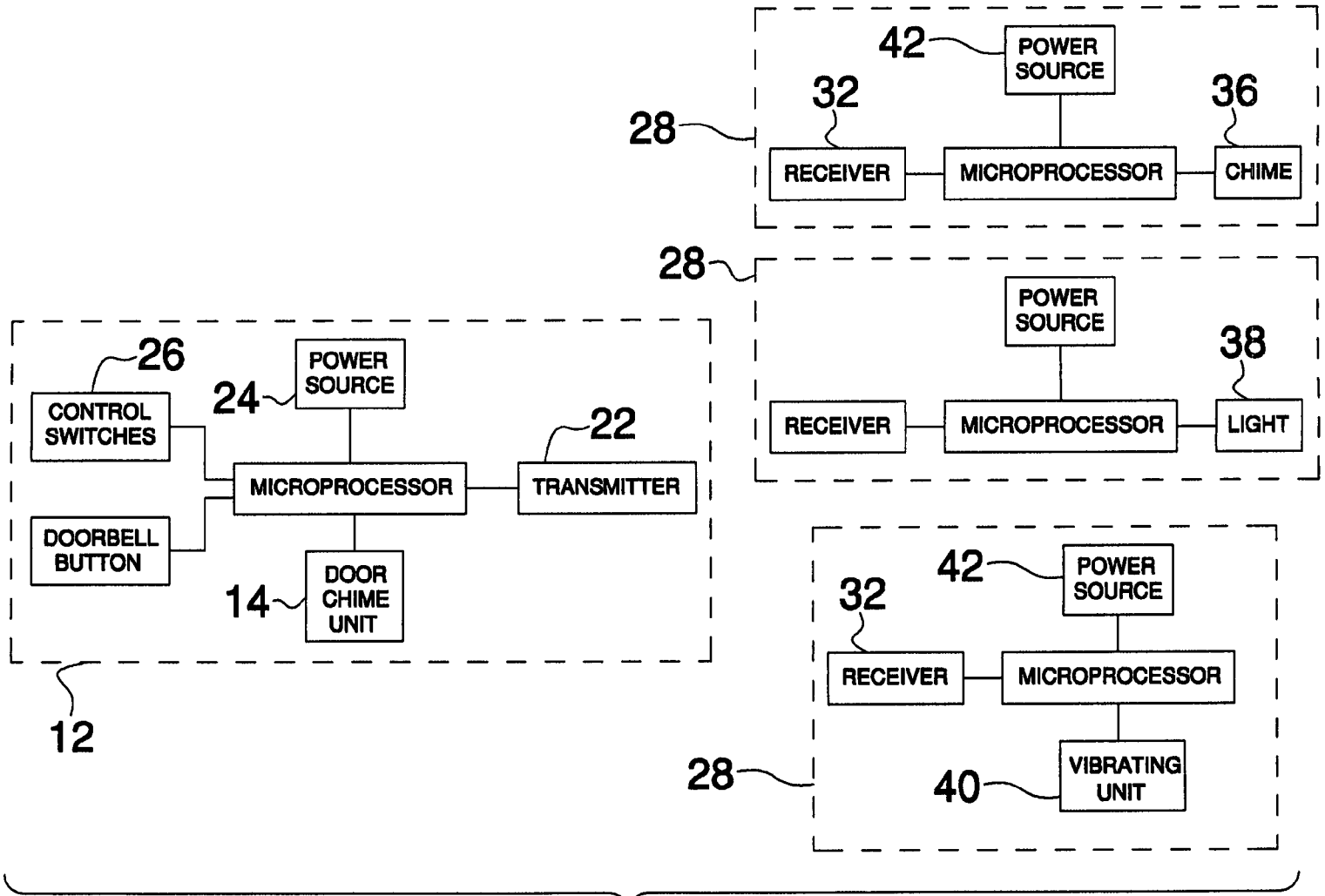
FIG. 5 is a schematic view of the present invention.

As best illustrated in FIGS. 1 through 5, the signaling system 10 generally comprises a primary signaling assembly 12 that includes a sound emitter 14, which may include a conventional chime 16 used for doorbells. An actuator 18 is electrically coupled to the sound emitter 14. The actuator 18 is a conventional doorbell actuator and may include secondary actuators 20. A transmitter 22 is electrically coupled to the actuator 18. The transmitter 22 is adapted for sending a wireless signal. A power supply 24 is electrically coupled to the actuator 18 for powering the sound emitter 14 and the transmitter 22. The power supply 24 is preferably the power supply of a dwelling and that is hardwired to the actuator 18. FIGS. 2 and 3 show variations of the system 10 depending on the types of power supplies being utilized.

The primary signaling assembly 12 includes a switch 26 that is electrically connected to the actuator 18 for selectively opening or closing the circuit between the actuator 18 and the transmitter 22 and sound emitter 14. The switch 26 may include a plurality of switches 26 electrically coupled to the actuator 18 for the purposes stated above. The switch 26 is selectively positioned in a first positioned opening a circuit between the actuator 18 and the transmitter 22 and sound emitter 14, a second position opening a circuit between the actuator 18 and the transmitter 22 and closing a circuit between the actuator 18 and the sound emitter 14, or in a third position closing a circuit between the actuator 18 and the transmitter 22 and sound emitter 14. The sound emitter 14 produces a sound when the actuator 18 is actuated and the switch 26 is positioned in the first position. The transmitter 22 transmits the wireless signal when the actuator 18 is actuated and the switch 26 is positioned in the first position or in the second position.

A plurality of secondary signaling assemblies 28 is provided. Each of the secondary signaling assemblies 28 includes a housing 30 and a receiver 32 that is positioned within the housing 30 and is adapted for receiving the wireless signal from the transmitter 22. A signal member 34 is positioned within the housing 30. The signal member 34 is electrically coupled to the receiver 32 and is adapted for signaling a person when the receiver 32 receives the wireless signal. The signal member 34 consists of a sound emitter 36, a light emitter 38 or a vibrating member 40. The sound emitter 36 may comprise any type of chime or speaker assembly adapted for emitting an audible sound when the receiver 32 receives a signal. The light emitter 38 is preferably a strobe light though any light emitting assembly may be used. The housing 30 is preferably translucent when the light emitter 38 is used. A power supply 42 is positioned within the housing 30 and is electrically coupled to the receiver 32 and the signal member 34.

In use, the primary signaling assembly 12 is used as a conventional doorbell signaling system to alert a person within a dwelling that a person is at the door of the dwelling. The secondary signaling assemblies 28 allow a person to place signal members where needed without the need of additional wiring. The secondary signaling assemblies 28 that include light emitters 38 and vibrating members 40 allow a person to be signaled in a non-audible manner. The switch 26 may be used to turn off the primary signaling assembly 10 to ensure that a person is not audibly disturbed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A signaling system comprising:

a primary signaling doorbell assembly including;

a sound emitter;

an actuator being electrically coupled to said sound emitter;

a transmitter being electrically coupled to said actuator, said transmitter being adapted for sending a wireless signal;

a power supply being electrically coupled to said actuator;

a switch being electrically connected to said actuator, said switch being selectively positioned in a first positioned opening a circuit between said actuator and said transmitter and sound emitter, a second position opening a circuit between said actuator and said transmitter and closing a circuit between said actuator and said sound emitter, or in a third position closing a circuit between said actuator and said transmitter and sound emitter, said sound emitter producing a sound when said actuator is actuated and said switch is positioned in said first position, said transmitter transmitting the wireless signal when said actuator is actuated and said switch is positioned in said first position or said second position;

a plurality of secondary signaling assemblies, each of said secondary signaling assemblies including;

a receiver being adapted for receiving said wireless signal from said transmitter;

a signal member being electrically coupled to said receiver, said signal member being adapted for signaling a person when said receiver receives said wireless signal; and a power supply being electrically coupled to said receiver and said signal member.

2. The system according to claim 1, wherein said signal member consists of a sound emitter, a light emitter or a vibrating member.

3. A signaling system comprising:

a primary signaling assembly including;

a sound emitter, said sound emitter comprising a chime;

an actuator being electrically coupled to said sound emitter;

a transmitter being electrically coupled to said actuator, said transmitter being adapted for sending a wireless signal;

a switch being electrically connected to said actuator, said switch being selectively positioned in a first positioned opening a circuit between said actuator and said transmitter and sound emitter, a second position opening a circuit between said actuator and said transmitter and closing a circuit between said actuator and said sound emitter, or in a third position closing a circuit between said actuator and said transmitter and sound emitter, said sound emitter producing a sound when said actuator is actuated and said switch is positioned in said first position, said transmitter transmitting the wireless signal when said actuator is actuated and said switch is positioned in said first position or said second position;

a power supply being electrically coupled to said actuator;

a plurality of secondary signaling assemblies, each of said secondary signaling assemblies including;

a housing;

a receiver being positioned within said housing and being adapted for receiving said wireless signal from said transmitter;

a signal member being positioned within said housing, said signal member being electrically coupled to said receiver, said signal member being adapted for signaling a person when said receiver receives said wireless signal, said signal member consisting of a sound emitter, a light emitter or a vibrating member; and a power supply being positioned within said housing and being electrically coupled to said receiver and said signal member.

* * * * *